United States Patent [19]

Hildebrandt

[11] Patent Number: 4,658,107

[45] Date of Patent: Apr. 14, 1987

[54] PLUG ASSEMBLY AND INTERCONNECTION SYSTEM

[75] Inventor: Eugene F. Hildebrandt, St. Louis County, Mo.

[73] Assignee: Emerson Electric Co., St. Louis, Mo.

[21] Appl. No.: 813,017

[22] Filed: Dec. 24, 1985

[51] Int. Cl.[4] ..... H01H 35/10

[52] U.S. Cl. ..... 200/80 R; 200/51.13; 339/91 R; 310/68 E

[58] Field of Search ..... 318/325, 462, 793; 310/68 E; 339/91 R; 200/80 R, 51 R, 51.13

[56] References Cited

U.S. PATENT DOCUMENTS 3,611,261 10/1971 Gregory ..... 339/113 R
3,753,212 8/1973 Yamada ..... 339/91 R
4,214,802 7/1980 Otani ..... 339/91 R
4,272,145 6/1981 LaDuke ..... 339/91 R
4,299,433 11/1981 Jayne ..... 339/91 R

*Primary Examiner*—G. P. Tolin
*Attorney, Agent, or Firm*—Polster, Polster and Lucchesi

[57] ABSTRACT

A housing with a relatively open end contains an electric motor starting switch. A plurality of terminals are secured to the housing and are disposed adjacent its relatively open end. A plug having a plurality of conductors for making electrical contact with the terminals is insertable in the relatively open end of the housing. A grounding buss is secured to the exterior of the housing and has a latching lug formed integrally therein. A mating latching mechanism is formed on the exterior of the plug to latch the plug to the housing when the plug is inserted in the relatively open end of the housing.

8 Claims, 6 Drawing Figures

PLUG ASSEMBLY AND INTERCONNECTION SYSTEM

BACKGROUND OF THE INVENTION

This invention relates to plug assemblies and interconnection systems for use with dynamoelectric machines, and more particularly to a plug assembly and interconnection system for an electric motor starting switch and the like.

Typically, capacitors start and split phase induction motors have a run winding and a starting or auxiliary winding. The starting winding is energized during startup of the motor (or when the speed of the motor falls below a specified operating speed) so as to create a rotating field in the stator and to provide sufficient torque to the rotor for starting purposes. However, once the motor has accelerated to a desired operating speed, the starting winding is no longer needed. As is conventional, a switch, referred to as a motor starting switch, is provided in the motor for energizing the starting winding only during startup of the motor and for deenergizing the starting winding once the motor has obtained its desired operating speed. These motor starting switches are conventionally actuated by centrifugal actuator mounted on and rotatable with the rotor shaft of the motor, the centrifugal actuator being responsive to the speed of the motor for changing the starting switch from its start to its run state in response to the motor attaining a predetermined operating speed.

In many applications, in addition to the switch which controls the starting winding, it is desirable to have one or more sets of auxiliary contacts to provide control signals or the like for the particular apparatus such as a washing machine or the like which incorporates the motor. Preferably, these control signals should occur simultaneously with the switching in or out of the starting winding. These auxiliary contacts are normally placed in a single housing with the starting switch. These auxiliary contacts or terminals form a plug assembly wnich can be connected to a plug from the apparatus itself for making electrical connection between the auxiliary terminals and the apparatus. It is desirable that the plug from the apparatus be easily inserted into the starting switch plug assembly and easily removed therefrom for purposes of servicing the apparatus and for assembly. However, because of the severe vibrations which occur in certain applications such as washing machines, it is necessary to provide some sort of latching mechanism between the apparatus plug and the starting switch plug assembly. Heretofore, such plug assemblies have been relatively easy to damage and not altogether satisfactory. For example, it would be desirable for latches used with such assemblies to have a positive latching feel and/or sound. In addition, such latches should keep the two plugs connected even when the wiring harnesss attached to the apparatus plug is jerked. Furthermore, such a latching mechanism should not interfere with the easy insertion of the apparatus plug into the starting switch plug assembly. Moreover, the terminals in prior starting switch plug assemblies may be bent and shorted if the apparatus plug is not inserted correctly.

SUMMARY OF THE INVENTION

Among the objects and features of the present invention may be noted the provision of a plug assembly and interconnection system which allows easy insertion and removal of an apparatus plug with respect to a starting switch plug assembly A second object of the present invention is the provision of such an assembly and system with an improved latching mechanism.

A third object of the present invention is the provision of such an assembly and interconnection system which reduces or eliminates the possibility of shorting or bending the starting switch plug terminals.

A fourth object of the present invention is the provision of such a latching mechanism which provides a positive discernible feel to the operator.

A fifth object of the present invention is the provision of a plug assembly and interconnection system which remains latched over a wider range of machine operations.

Other objects and features of this invention will be in part apparent and in part pointed out hereinafter.

BRIEF DESCRIPTION OF THE DRAWINGS

Similar reference characters indicate similar parts throughout the several views of the drawings.

DESCRIPTION OF THE PREFERRED EMBODIMENT

Figure 1:
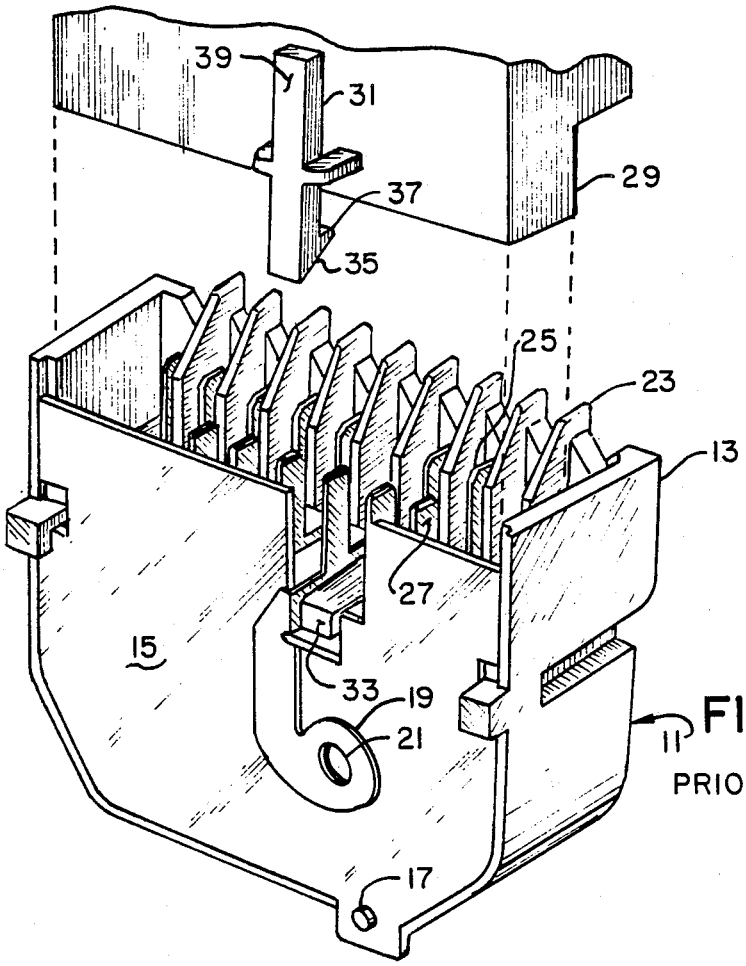
FIG. 1. PRIOR ART.
FIG. 1 is a perspective view illustrating an interconnection system of the prior art.

A prior art starting switch plug assembly 11 (FIG. 1) included an insulative housing 13 having a removable insulative cover 15. At the lower end of cover 15 a pivot 17 for a actuator arm (see FIG. 3) of the motor starting switch is suitably mounted. A grounding buss 19 is disposed on the outer surface of cover 15 and is electrically connected to the case of an electric motor (not shown) by a threaded fastener 21 which also connects the plug assembly to the electric motor. The plug assembly is secured in place to the motor housing such that the centrifugal actuator of the motor strikes the actuator arm of the switch plug assembly at the appropriate time.

Housing 13 has a set of insulative lead separators integrally molded into the rear of the housing. Separators 23 separate and insulate the various leads coming from the motor and the power supply from each other. These leads are connected to a set of contacts 25 disposed between adjacent separators. Heretofore, these separators have been somewhat taller than the side walls of housing 13 as is shown in FIG. 1.

The prior art starting switch plug assembly also includes a set of contacts or terminals 27 for making an electrical connection with an external apparatus such as a washing machine. A plug 29 containing mating terminals is used for making electrical connection with the terminals 27 of plug assembly 11. Plug 29 fits down inside housing 13. A nylon latch 31 is provided on plug 29 to latch plug 29 to plug assembly 11. Plug assembly 11 further includes a mating latching post 33 which is disposed so as to hold latching mechanism 31 in place when plug 29 is fully inserted into plug assembly 11. To facilitate this latching, latching mechanism 31 includes a ramp 35 so that as plug 29 is moved downwardly the ramp forces latching mechanism 31 outwardly at the bottom to clear latching post 33 of the plug assembly. Once the latching post is cleared, the natural rigidity of latching mechanism 31 forces a lip 37 on latching mechanism 31 under latching post 33 to hold plug 29 in place with respect to plug assembly 11. For removal of plug 29 from the plug assembly, an upwardly extending post 39 of the latching mechanism is depressed which frees lip 37 from contact with post 33. Plug 29 can then be withdrawn.

Although the plug assembly 11 and latching mechanism 31 of the prior art were satisfactory in many respects, they could be improved. For example, there was a possibility that plug 29 if not aligned properly with housing 13 could bend some terminals 27 of the plug assembly as plug 29 was being inserted. In addition, the latching mechanism was not as reliable as could be desired.

Figure 2:
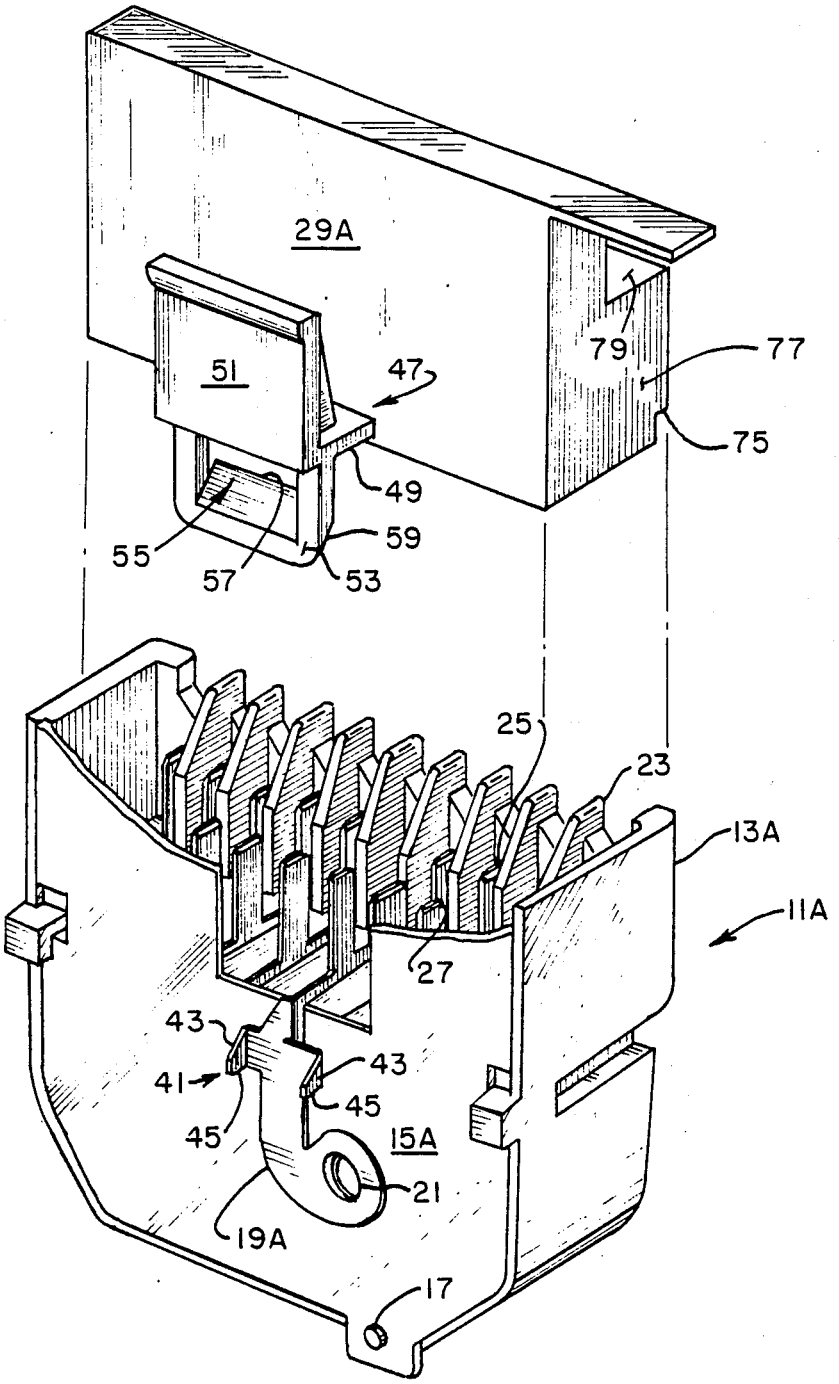
FIG. 2 is a perspective view similar to FIG. 1 illustrating a first embodiment of the present invention.

The plug assembly of the present invention, labelled 11A (see FIG. 2), has a housing 13A which differs from housing 13 of the prior art chiefly in that the sides of the housing come up to the same level as the tops of separators 23. Similarly the cover 15A of plug assembly 11A comes up generally to the level of the top of separators 23. This construction provides a defined alignment space into which a plug 29A from the apparatus such as a washing machine must be fitted before the plug comes into contact with terminals 27. The walls of housing 13A and cover 15A thereby align plug 29A with plug assembly 11A and prevent the bending of terminals 27 which could occur with the prior art plug assembly.

Grounding buss 19A of plug assembly 11A has integrally formed therein a locking lug 41 extending generally perpendicularly or transversely out from cover 15A of housing 13A. Lug 41 includes a pair of outwardly and downwardly extending ramps 43 and a pair of generally flat lower surfaces 45 providing a latching surface for plug assembly 11A. Plug 29A includes a mating nylon locking mechanism 47 having a first portion 49 integrally molded with plug 29A, a second portion 51 disposed at the distal end of first portion 49 and extending upwardly therefrom to provide a manually actuable surface for unlatching plug 29A from plug assembly 11A, and a third portion 53 disposed generally toward the distal end of first portion 49 and extending downwardly therefrom. Third portion 53 defines an encircled opening 55 which contains lug 41 when plug 29A is fully inserted into plug assembly 11A. The opening has a lower edge 57 which prevents upward movement of plug 29A when it is in place in plug assembly 11A by engaging the latching surface 45 of lug 41.

Downwardly extending portion 53 of the latching mechanism 47 has an upwardly and inwardly extending ramp 59 at its lower extent so that the lower part of latching mechanism 47 is bent away from the body of plug 29A as ramp 59 rides over outwardly extending ramp 43 of lug 41. Once edge 57 of the latching mechanism clears lug 41 as the plug is being pushed downwardly, latching mechanism 47 snaps back into its normal orientation with an audible sound with lug 41 trapped in opening 55 of the latching mechanism. Plug 29A is unlatched by the application of an inward force to manually actuable portion 51 of the latching mechanism. This force causes the lower portion of the latching mechanism to bend out away from lug 41 a sufficient distance so that edge 57 can clear lug 41 and plug 29A can be removed from plug assembly 11A.

Figure 3:
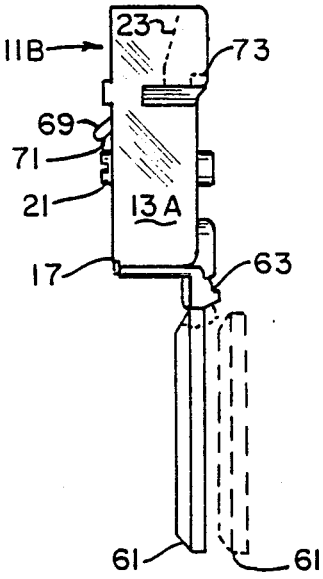
FIG. 3 is a side elevation illustrating the actuation of a starting switch incorporated in a plug assembly of the present invention.

Another embodiment 11B of the present invention is shown in FIG. 3 in combination with a centrifugal actuator 61 of an electric motor. During starting of the motor, centrifugal actuator 61 is in the position shown in solid lines, in which it contacts an actuator arm 63 secured to plug assembly 11B. When the motor comes up to a predetermined speed, the centrifugal actuator moves to the position shown in dashed lines and the actuator arm is released.

Figure 4:
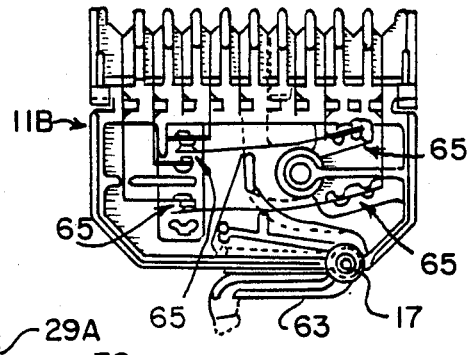
FIG. 4 is an elevation with parts removed for clarity of the interior of the plug assembly of the present invention.

As is shown in FIG. 4, the actuator arm 63 is operatively connected to a plurality of switch contacts 65 which make electrical interconnections between the terminals of the plug assembly in the conventional manner. More specifically, tne pivoting of actuator arm 63 about axis 17 as controlled by centrifugal actuator 61 causes certain connections to be made in the plug assembly and certain other connections to be broken.

Referrrng back to FIG. 3, plug assembly 11B includes a latching lug 69 of a somewhat different configuration. Lug 69 is smoother than lug 41 and includes an undercut 71 which forces surface 57 of the latching mechanism inwardly toward plug assembly 11B as plug 29A is pulled upwardly. This construction tends to further reduce the inadvertent removal of plug 29A from plug assembly 11B.

Plug assembly 11B also includes an internal ledge 73 at the rear wall of housing 13A. This ledge functions with a corresponding ledge 75 (FIG. 5) on plug 29A to force the latching mechanism 47 into secure engagement with lug 69 during insertion of plug 29A into plug assembly 11B. Ledge 75 is formed in the two downwardly depending walls 77 of plug 29A, which walls together with an integrally formed rear cover 79 cover terminals 25 when the plug and plug assembly are connected.

Figure 5:
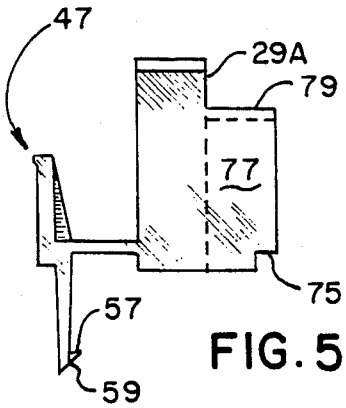
FIG. 5 is a side elevation of an apparatus plug and latching mechanism of the present invention.

As is seen most clearly in FIG. 5, edge 57 which engages lug 69 is also upwardly and inwardly ramped to promote secure latching upon upward movement of plug 29A with respect to the plug assembly. Ramped edge 57 cooperates with the ramped bottom of lug 69 as the plug is pulled upwardly to more firmly latch the plug to the plug assembly.

Figure 6:
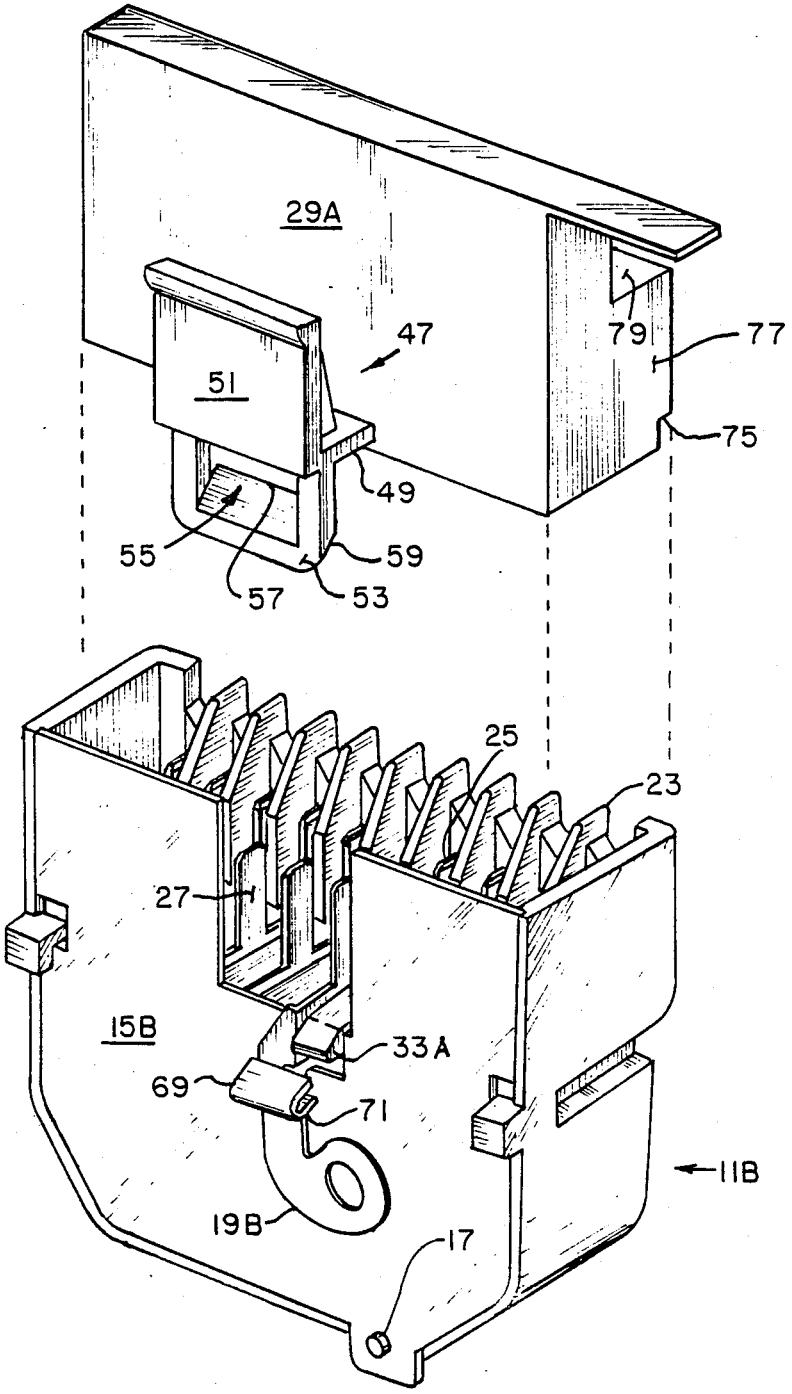
FIG. 6 is a perspective view illustrating a second embodiment of the plug assembly of the present invention.

Plug assembly 11B differs from plug assembly 11A further in that it includes two latches (see FIG. 6). The first, integrally formed grounding buss latching lug 69 extends perpendicularly or transversely out from the cover 15B of the assembly and cooperates with latching mechanism 47 to latch plug 29A in place. This lug is smoothly curved to eliminate any sharp corners. Plug assembly 11B further includes a latching post 33A such as that used in the prior art plug assemblies shown in FIG. 1 so that a prior art plug 29 can also be used with plug assembly 11B in place of plug 29A if desired.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A plug assembly for an electric motor starting switch comprising:

a housing having an open end;

a plurality of terminals disposed adjacent the open end of the housing such that electrical contact is made between conductors of an external plug and the terminals;

an electric motor starting switch disposed in said housing and electrically connected to the terminals such that the electrical connections between the terminals are a function of whether the electric motor starting switch is open or closed, said electric motor starting switch having an actuator arm extending outside the housing, whereby the electric motor starting switch is operable by a centrifugal actuator; and a grounding buss secured to and accessible from the exterior of the housing, said grounding buss having conductive latching means formed integrally therein and extending exteriorly of the housing, said latching means latchingly mating with a corresponding structure on the external plug, whereby the latching means latches the external plug to the plug assembly.

2. The plug assembly as set forth in claim 1 wherein the latching means includes a lug spaced from the open end of the housing.

3. The plug assembly as set forth in claim 2 wherein the lug extends transversely out from the housing.

4. The plug assembly as set forth in claim 1 wherein the latching means includes a lug undercut on the side thereof distal the open end of the housing to form a ramp extending inwardly toward the housing and upwardly toward the open end of the housing, said latching means including a sloped ramp extending in generally the same direction as the lug ramp and cooperating therewith to more firmly latch the plug to the plug assembly when the plug and plug assembly are attempted to be pulled apart.

5. An interconnection system for use with an electric motor comprising:

a housing having an open end;

a plurality of terminals secured to the housing and disposed adjacent the open end thereof;

a plug having a plurality of conductors in removable electrical contact with said plurality of terminals with said plug inserted in the open end of the housing;

an electric motor starting switch disposed in said housing and electrically connected to at least some of the terminals such that the electrical connections between said terminals are a function of whether the electric motor starting switch is open or closed, said electric motor starting switch being operable by a centrifugal actuator;

a grounding buss secured to and accessible from the exterior of the housing, said grounding buss having conductive latching means formed integrally therein and extending exteriorly of the housing; and mating latching means secured to and disposed exteriorly of the plug mating with the grounding buss latching means to latch the plug to the housing with said plug inserted in the open end of the housing.

6. The interconnection system as set forth in claim 5 wherein the grounding buss latching means includes a lug disposed on one side of the housing and spaced from the open end thereof.

7. The interconnection system as set forth in claim 5 wherein the housing includes auxiliary latching means including a latching post which extends out from the housing a distance significantly less than the distance the grounding buss latching means extends out from the housing.

8. The interconnection system as set forth in claim 5 wherein the housing defines an alignment space at its open end which the plug must enter before contacting the terminals, the alignment space having substantially the same cross section as the plug so as to align the plug with the terminals.

* * * * *